US010524623B2

(12) United States Patent
Halonen et al.

(10) Patent No.: US 10,524,623 B2
(45) Date of Patent: Jan. 7, 2020

(54) FOLDABLE POTTY

(71) Applicant: Buubla Oy, Espoo (FI)

(72) Inventors: Sanna-Mari Halonen, Espoo (FI); Henri Halonen, Espoo (FI)

(73) Assignee: BUUBLA OY, Espoo (FI)

( * ) Notice: Subject to any disclaimer, the term of this patent is extended or adjusted under 35 U.S.C. 154(b) by 0 days.

(21) Appl. No.: 16/296,875

(22) Filed: Mar. 8, 2019

(65) Prior Publication Data

US 2019/0274494 A1 Sep. 12, 2019

(30) Foreign Application Priority Data

Mar. 9, 2018 (FI) ..... 20185219

(51) Int. Cl.
*A47K 11/02* (2006.01)
*A47K 11/06* (2006.01)

(52) U.S. Cl.
CPC ..... *A47K 11/02* (2013.01); *A47K 11/06* (2013.01)

(58) Field of Classification Search
CPC ..... A47K 11/02
USPC ..... 4/484
See application file for complete search history.

(56) References Cited

U.S. PATENT DOCUMENTS 1,663,966 A 3/1928 Cotton et al.
5,732,418 A * 3/1998 Sekitou ..... A47K 11/02 4/449
7,334,273 B2 2/2008 Thomas
2009/0165199 A1* 7/2009 Heumann ..... A47K 11/02 4/483
2010/0275362 A1* 11/2010 Biesinger ..... A47K 11/02 4/483
2012/0192343 A1* 8/2012 Richardson ..... A47K 11/02 4/449
2013/0227776 A1* 9/2013 Ito ..... A47K 11/02 4/479

FOREIGN PATENT DOCUMENTS

GB 2 184 650 A 7/1987
GB 2 220 566 A 1/1990
JP H11225910 A 8/1999
JP 2017-225655 A 12/2017
KR 20080015490 A 2/2008
KR 101650536 B1 8/2016
TW M492712 U 1/2015
WO 8911317 A2 11/1989
WO 2013/122487 A2 8/2013

OTHER PUBLICATIONS

FI Search Report, dated Jun. 25, 2018, from corresponding FI 20185219 application.
Extended European Search Report for European Patent Application No. 19161294.4 dated Jul. 19, 2019.

* cited by examiner

*Primary Examiner* — Huyen D Le
(74) *Attorney, Agent, or Firm* — Young & Thompson

(57) ABSTRACT

A potty is provided including a foldable element and a support element, wherein the foldable element is configured as a receptacle made of a resilient material, and wherein the support element is made of a stiff material and forms lateral sections of the potty. The foldable element folds longitudinally upon forcing the lateral sections towards one another; thereupon the entire potty gear is essentially size-reduced.

13 Claims, 4 Drawing Sheets

FOLDABLE POTTY

FIELD OF THE INVENTION

Generally the present invention relates to potty gear solutions for infants. In particular, the invention concerns a foldable potty chair suitable for use as a portable- and/or a travel potty, for example.

BACKGROUND

Traveling with infants that have outgrown their nappies and/or during the period of their potty training might be a challenge for parents or guardians, due to a necessity to carry along all the training gear, such as a potty chair or a kids' adapted lavatory seat.

Most common problems that arise during that time are associated with an infant's desire to do things solely into a familiar, home-use potty, which is often provided as quite a massive chair; thereby, is not particularly suitable for air travel, for example, and/or any kind of long or short travel. Even relatively compact potty gear, such as one-piece molded solutions, for example, is often challenging to fit into a (hand) luggage or a bag due to a specific shape of said potty gear. From the other hand, lavatory seats adapted for kids, although flat and convenient to carry, are rather poorly suitable for infants aged 1-3 years, in terms of the infants' (small) size and general considerations of hygiene.

Foldable, defined hereby as collapsible and expandable, potty chair solutions provide a feasible solution for use during traveling, camping, shopping and/or staying at somebody's house, for example. By the way of an example, WO 2013/122487 (Pancerz et al) teaches a disposable folding potty comprising a plurality of annularly arranged vertical folds with a folding direction towards the center of a receptacle. Due to provision of multiple interconnected elements, feasibility of this potty device in sometimes harsh travelling conditions appears questionable. Portable potty solutions, in where folding is implemented by piling a receptacle down, are further described in the patent publications GB 2 184 650 (Beer et al) and U.S. Pat. No. 7,334,273 (Thomas). All abovementioned solutions require fitting a disposable bag therewithin, which is not always possible/convenient in conditions of "emergency".

In this regard, it is still desirable to provide a smart and simple solution for a portable potty gear that would turn out sufficiently comfortable for an infant and, at the same time, cause least trouble to parents, with regard to transporting, (dis)assembling and cleaning.

SUMMARY OF THE INVENTION

An objective of the present invention is to remove or at least to mitigate the drawbacks of the related art. The objective is achieved by various embodiments of a foldable potty provided according to what is defined in the independent claim 1.

In preferred embodiment, a potty is provided comprising a foldable element and a support element, wherein the foldable element is configured as a receptacle with a front end and a rear end, said receptacle being made of a resilient material, and wherein the support element is configured as at least two discrete sub-elements disposed between the front end and the rear end of the receptacle at each side thereof such, as to form lateral sections of the potty.

In preferred embodiments, the resilient material of the receptacle corresponding to the foldable element is configured to flex upon impact. It is further preferred that the support element is made of a material stable in shape upon impact.

In some embodiments the lateral sections are configured as round-arched bodies positioned with their concave faces opposite to one another to incorporate the receptacle therebetween.

In some embodiments, the foldable element and the support element are made of polymeric materials. In further embodiments, said polymeric materials are a selection of thermoplastic polymers or blends thereof.

In some embodiments, the support element is made of a material superior to the material of the foldable element in terms of at least stiffness.

In preferred embodiments, the foldable element is configured to fold longitudinally; thereupon the distance between the lateral sections is reduced. In some embodiments, said distance is reduced at least twice.

In some embodiments, the foldable element is configured to retain its folded shape until a counter-impact is applied thereto, upon that original, fully unfolded state of the potty is reinstated. In some further embodiments, the foldable element is configured to restore its unfolded shape once an impact action discontinues, upon that an original, fully unfolded state of the potty is reinstated In some embodiments, the receptacle further comprises an extension at its front end.

In preferred embodiments, the foldable element and the support element form a body shape-adapted potty chair to accommodate a child, while the potty is provided in an original, fully unfolded state.

In another aspect use of the potty according to the previous aspect as a portable- and/or a travel chamber pot is provided, according to what is defined in the independent claim 14.

The utility of the present invention arises from a variety of reasons depending on each particular embodiment thereof. On the whole, the potty solution provided hereby, in its fully unfolded state mimics, in terms of shape, a solid, home-use potty gear, which presence is in some instances indispensable to invoke necessary reflexes, in particular, in strange conditions associated with travelling. It is clear that little kids relax more easily in the presence of familiar items, therefore, provision of a travel potty similar to the home-use one essentially facilitates and speeds up a restroom visit.

The present potty solution is made of safety-approved plastics materials; it is easily washable and contains no sharp edges or prominent parts. The present potty solution is further implemented with a limited number of components in an absence of joint connections; thereby, its' chances to get damaged upon being stuffed into a travel bag are minimized. The potty solution disclosed hereby thus combines compactness with supreme durability, which makes it an appearing solution for families with several kids close in age.

Different embodiments of the present invention will become apparent by consideration of the detailed description and accompanying drawings.

DETAILED DESCRIPTION OF THE EMBODIMENTS

Figure 1A:
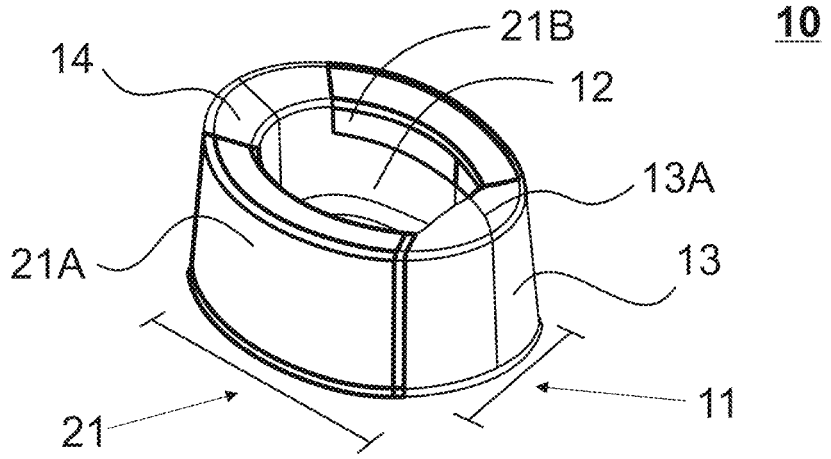
FIG. 1A is a perspective view of a potty 10, according to an aspect of the present invention, in an original, fully unfolded state. For the same.

Detailed embodiments of the present invention are disclosed herein with the reference to accompanying drawings. The same reference numerals are used throughout the drawings to refer to same members as follows:

10—a potty;
11—a foldable element;
12—a receptacle;
13, 13A—a front end of the receptacle, and an extension thereof, accordingly;
14—a rear end of the receptacle;
21—a support element;
21A, 21B—support sub-elements/lateral sections of the potty 10.

FIG. 1A illustrates at 10 a concept underlying various embodiments of a potty in accordance with the present invention. In preferred embodiment the potty 10 comprises a foldable element 11 and a support element 21.

Figure 1B:
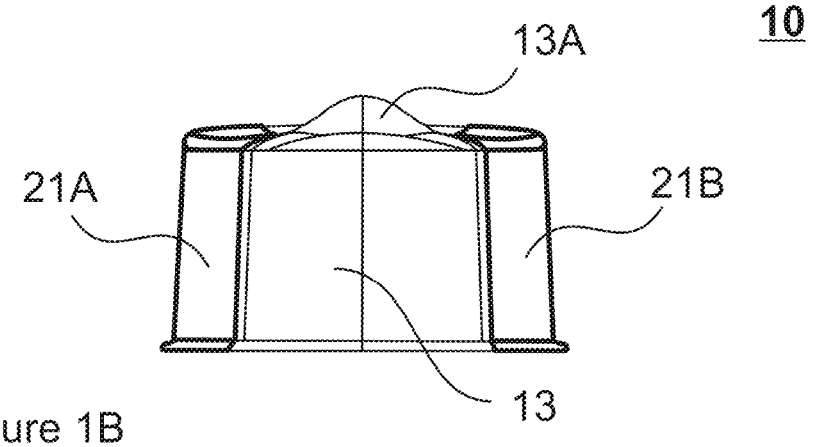
FIGS. 1B and 1C are a front view and a view from above, accordingly.

The foldable element 11 is configured as a receptacle 12 with a front end 13 and a rear end 14, said receptacle being made of a resilient, flexible material. In some embodiments, the receptacle 12 further comprises an extension 13A at the front end 13 (FIG. 1B).

The support element 21 is, in turn, configured in the form of at least two discrete sub-elements disposed between the front end 13 and the rear end 14 of the receptacle 12 at each side thereof such, as to form lateral sections 21A, 21B of the potty 10. In preferred embodiments, the support element 21 consists of two sub-elements, each forming a discrete lateral section 21A, 21B. On FIGS. 1A-1C the lateral sections 21A, 21B are further emphasized in bold.

The lateral sections 21A, 21B are configured as round-arched bodies positioned with their concave faces opposite to one another such, as to incorporate the receptacle 12 therebetween. Apart from their mirror-symmetrical disposition and optionally color(s) and/or surface design elements, the lateral section 21A and 21B are preferably identical.

Figure 1C:
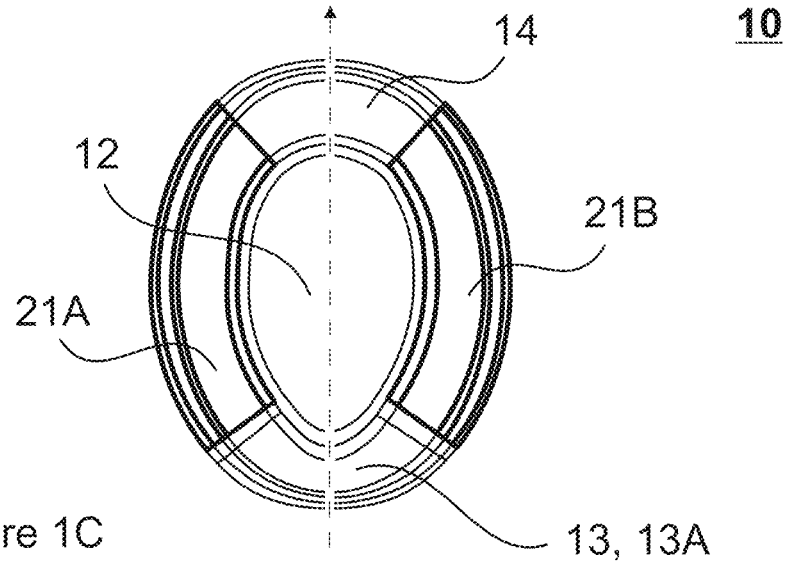

With reference to FIG. 1C the potty 10 is preferably provided as a longitudinally elongated roundish body, whose outline (when looked from above or from below) is generally oval-shaped. In some configurations said outline is ovoid-shaped (egg-shaped) with pronounced front- and rear ends; in some other configurations said outline is elliptical.

In any configuration it is essential, that when the potty 10 is provided in its original, fully unfolded state (FIG. 1A), the foldable element 11 and the support element 21 form a potty chair to accommodate a (seated) child. Said potty chair 10 is preferably anatomic shaped aka generally body shape-adapted.

Figure 2B:
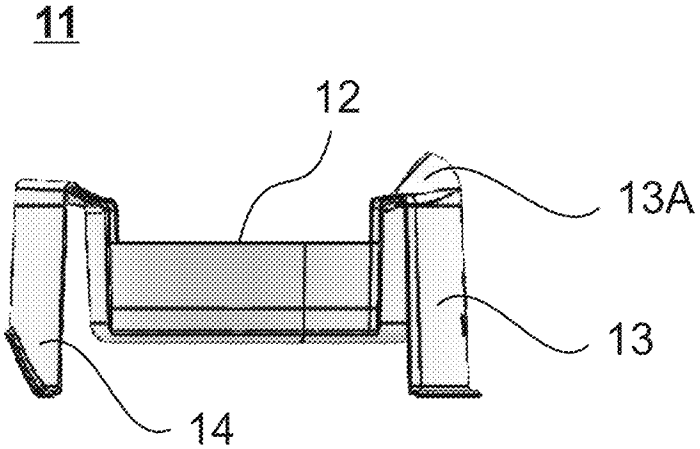
FIGS. 2A-2C show a perspective view, a side view, and a front view, accordingly, for a foldable element of the potty 10, in a fully unfolded state.
Figure 2A:
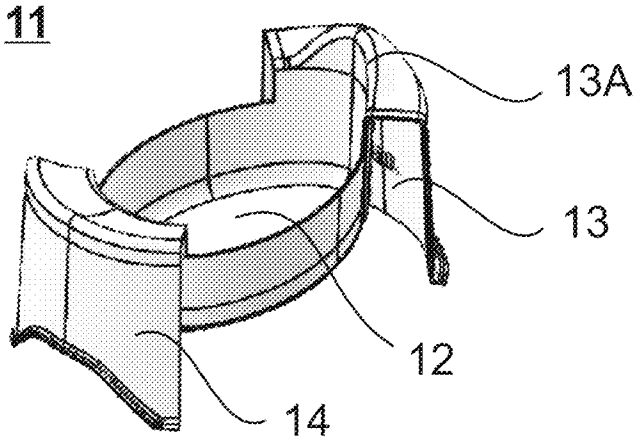
Figure 2C:
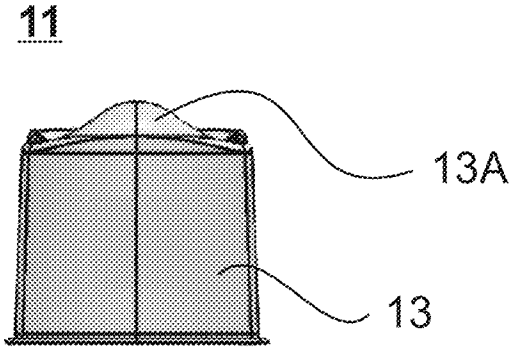
Figure 3A:
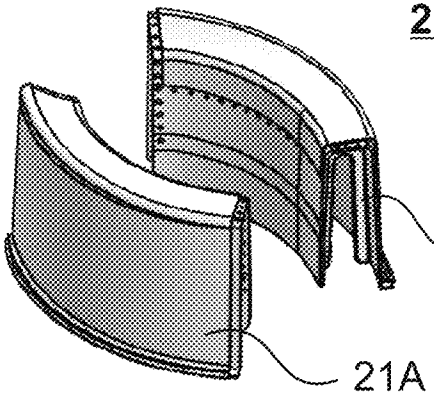
FIG. 3A-3D show a perspective view, a front view, a view from above and a view from below, accordingly, for a support element of the potty 10.
Figure 3B:
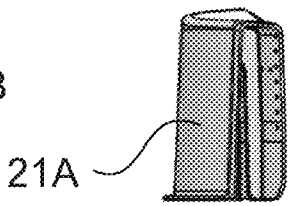
Figure 3C:
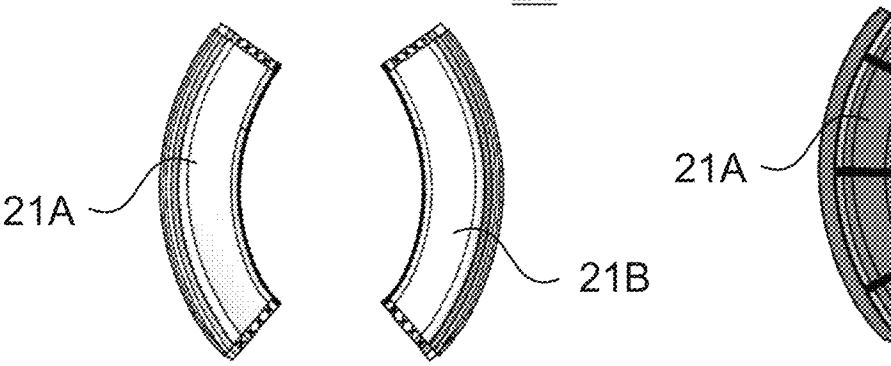
Figure 3D:
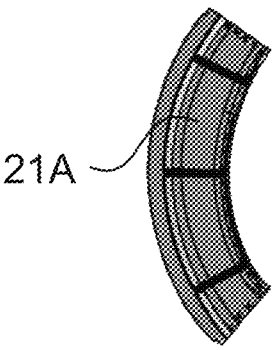

FIGS. 2A-2C and FIGS. 3A-3D further show the foldable element 11 and the support element 21 from different perspectives, accordingly. In preferred embodiments, the lateral sections 21A, 21B of the support element 21 are configured as roundish, arch-shaped bodies hollow from inside and in an absence of a solid bottom (FIGS. 3A, 3D). Hollow and bottomless configuration reduces weight of the overall construction and facilitates its cleaning. The above-said applies also to the foldable element 11 at the ends 13, 14 of the receptacle 12 (FIGS. 2A, 2B).

The lateral sections 21A, 21B are provided as stable, self-supporting bodies with their bases or lower edges fully contacting an underlying surface. The lateral sections 21A, 21B keep the potty 10 is its fully unfolded position (FIG. 1A), when said potty 10 is in use, aka a child is seated on it.

The foldable element 11 is preferably provided as a one-piece element, in which the receptacle 12, at its' central part, is provided as an ovoid- or ellipse-bottomed bowl, surrounded at its' edges by the arched ends 13, 14 and the lateral support sections 21A, 21B (the latter provided separately). The foldable element 11 is preferably configured such that a predetermined distance is formed between the bottom of the receptacle 12 and the underlying surface (FIGS. 2A, 2B).

In some embodiments, the foldable element 11 and/or the lateral (support) sections 21A, 21B may be implemented as layered solutions.

In some embodiments, a non-slip coating material, such as rubber, can be provided at the bases of the lateral sections 21A, 21B and, optionally, of the receptacle 12, to prevent slipping of the potty 10 from wet- or otherwise slippery surfaces.

In preferred embodiments the lateral sections 21A, 21B are permanently joined to the receptacle 12 during manufacturing. This allows for attaining maximum stability for the potty 10 and for avoiding appearance of gaps between the elements 11, 21. In some supplementary configurations, the potty 10 can be provided as a modular solution, in where the lateral sections 21A, 21B are detachable from the receptacle 12 and replaceable.

As mentioned hereinabove, the receptacle 12 that constitutes the foldable element 11 is made of a resilient, soft material. In preferred embodiments, the resilient material of said receptacle 12 (and the foldable element 11) is configured to flex upon impact. Said resilient material is thus deformable by pressing, bowing, bending, twisting, turning, and the like, without breaking or getting damaged.

On the contrary, the support element 21 and its sub-elements that form the lateral sections 21A, 21B, accordingly, is/are made of a stiff, sturdy material stable in shape upon impact. For the sake of clarity, in the present disclosure we primarily refer to manual (human) impact, implemented in an absence of supplementary mechanical means.

Thereby, the support element 21 (21A, 21B) is configured such, that upon (manual) impact the above mentioned deformation-related actions cause no effect thereon, i.e. the shape of said support element 21 does not change. However, via said stiff lateral sections 21A, 21B the impact action can be mediated to the foldable element 11, as described further below.

In preferred embodiments the foldable element 11 and the support element 21 are made of polymeric materials. Said polymeric materials are preferably configured as a selection of thermoplastic polymers or blends thereof. Material selection complies with safety standards, in particular, the Children's Apparel and Accessories Product-related standards and associated guidelines.

In some configurations the thermoplastic polymers include, but are not limited to: polyethylene (PE), polypropylene (PP), polyvinyl chloride (PVC), ethylene-vinyl acetate (EVA), Acrylonitrile Butadiene Styrene (ABS), polycarbonate (PC), silicon polymers, thermoplastic elastomers (TPE), and blends thereof.

In all instances, the support element 21 is made of a material superior to the material of the foldable element 11 in terms of at least stiffness. By stiffness we refer hereby to a measure of rigidity of the material, defined by ability thereof to withstand bulk deformation in response to applied force. The support element 21 is stiff as it remains undeformed upon impact, as described hereinabove.

By the way of an example, resilient materials may include PE (e.g. low-density PE), PP, PVC, TPE, silicone polymers and blends thereof whereas the stiff materials may include PE (e.g. high-density PE), PP, PVC, EVA, ABS, PC, and blends thereof.

The elements 11, 21 can be manufactured by molding, such as injection molding or compression molding, for example. Other manufacturing processes, such as additive manufacturing/3D printing, are also not excluded.

In preferred embodiments, the potty 10 is configured foldable/collapsible. The potty 10, as shown on FIG. 1A, for example, is folded longitudinally (along a longitudinal axis thereof, shown on FIG. 1C by an arrow).

Figure 4C:
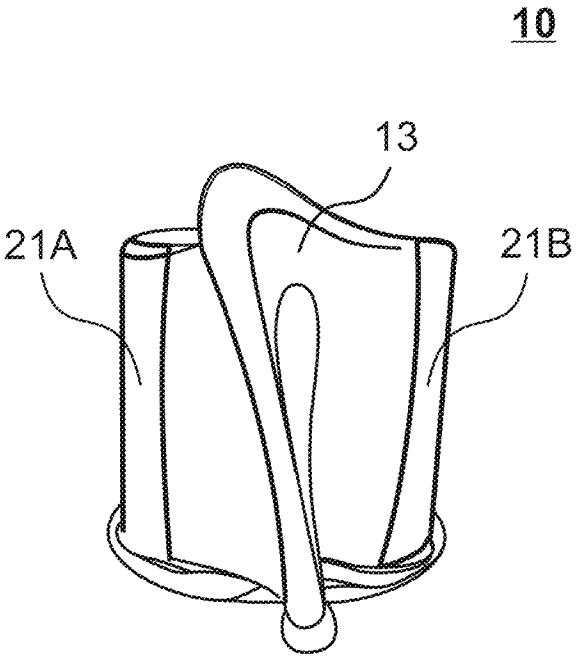
FIGS. 4A-4C show a perspective view, a view from above and a front view, accordingly, for the potty 10 in a folded state.
Figure 4B:
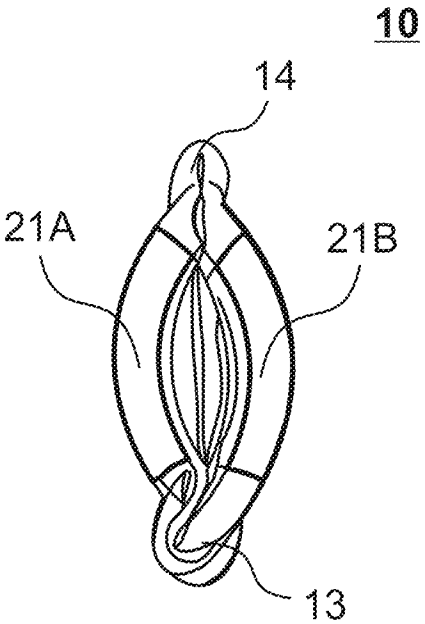
Figure 4A:
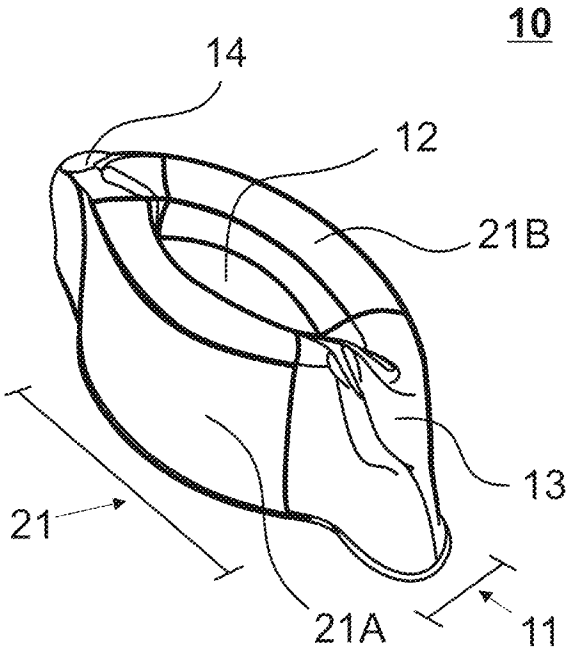

FIGS. 4A-4C further illustrate the potty 10 in its folded state. Upon folding, the foldable element 11 collapses in a longitudinal direction; thereby distance between the lateral sections 21A, 21B is reduced such, that said arched lateral sections are brought as proximal as to contact one another at both curvature ends (FIGS. 4A, 4B). Along its longitudinal axis, the potty 10 thus acquires a horizontally oblate, flattened shape, as being depressed at its sides. Upon folding, the receptacle 12 collapses, whereas front- and rear ends 13 and 14 pleat and protrude in a longitudinal direction. It should be noted that a folding pattern shown on FIGS. 4A-4C is exemplary; thereby, each time upon folding the elements 13, 14 may pleat in a slightly different manner.

Upon (manual) folding the lateral sections 21A, 21B are thus brought towards one another. As said lateral sections approach each other, the receptacle 12 is compressed such, as to form prominent pleats at its ends 13, 14. We note hereby, that the above described folding procedure is applicable solely when the receptacle 12 is empty.

In some embodiments, upon longitudinal folding of the potty 10, the distance between lateral sections 21A, 21B is reduced at least twice, as compared with the distance between said lateral sections 21A, 21B in an original, fully unfolded state (i.e. when comparing the potty shown on FIGS. 1A and 4A, for example).

The potty 10 is further configured as an expandable item, in a meaning that it fully reinstates its original, unfolded shape.

In some embodiments, the foldable element 11, in terms of material choice and its properties, can be configured to restore its unfolded shape immediately upon termination of the impact action. Thereby, original, fully unfolded state of the potty 10 is reinstated. Thus, once the impact action that forces lateral sections 21A, 21B towards one another is discontinued, the foldable element 11 expands (unfolds) back to its original position. Such a configuration may require provision of additional retention means (not shown) to hold the potty 10 in a folded/collapsed state.

In some alternative embodiments, the foldable element 11, in terms of material choice and properties thereof, is configured to retain its folded shape until counter-impact is applied. Thus, brought together lateral sections 21A, 21B do not expand, but retain in a collapsed state (FIG. 4A), even in an absence of further impact action, until a counter-impact is applied thereto. The counter-impact is an action that restores the original, fully unfolded state of the potty 10 (FIG. 1A). Said counter-impact action is conducted by pulling the lateral sections 21A, 21B apart from one another, thereupon the foldable element 11 re-acquires the shape of the receptacle 12.

Impact force and counter-impact force are regulated by the choice of material(s) for the element 11 and properties thereof, such as resilience, density, thickness, etc.

The potty 10 is preferably standardly dimensioned with a holding capacity 1-1.5 liters. The potty 10 can be provided in different sizes according to age groups (e.g. for kids aged 1-2 years, 3-4 years and 5-6 years). It is further preferred that the elements 11, 21 that constitute the potty 10 are liquid-impermeable.

In another aspect of the invention use of the potty 10 is provided as a portable- or a travel chamber pot, in particular, configured for infants and toddlers aged 1-6 years.

It is clear to a person skilled in the art that with the advancement of technology the basic ideas of the present invention are intended to cover various modifications included in the scope thereof. The invention and its embodiments are thus not limited to the examples described above; instead they may generally vary within the scope of the appended claims.

The invention claimed is:

1. A potty comprising a foldable element and a support element, characterized in that the foldable element is configured as a receptacle with a front end and a rear end, said receptacle made of a resilient material, and wherein the support element is configured as at least two discrete sub-elements disposed between the front end and the rear end of the receptacle at each side thereof to form lateral sections of the potty, and wherein said lateral sections are configured as round-arched bodies positioned with their concave faces opposite to one another to incorporate the receptacle therebetween.

2. The potty of claim 1, in which the resilient material of the receptacle is configured to flex upon impact.

3. The potty of claim 1, in which the foldable element and the support element are made of polymeric materials.

4. The potty of claim 3, in which the polymeric materials are a selection of thermoplastic polymers or blends thereof.

5. The potty of claim 1, in which the support element is made of a material stable in shape upon impact.

6. The potty of claim 1, in which the support element is made of a material superior to the material of the foldable element in terms of at least stiffness.

7. The potty of claim 1, wherein the foldable element is configured to fold longitudinally, thereupon the distance between the lateral sections is reduced.

8. The potty of claim 7, wherein upon longitudinal folding of the foldable element the distance between the lateral sections is reduced at least twice.

9. The potty of claim 1, wherein the foldable element is configured to retain its folded shape until a counter-impact is applied thereto, upon that an original, fully unfolded state of the potty is reinstated.

10. The potty of claim 1, wherein the foldable element is configured to restore its unfolded shape once an impact action discontinues, upon that an original, fully unfolded state of the potty is reinstated.

11. The potty of claim 1, wherein the receptacle further comprises an extension at the front end.

12. The potty of claim 1, wherein, with said potty being in its original, fully unfolded state, the foldable element and the support element form a body shape-adapted potty chair to accommodate a child.

13. Use of the potty as defined in claim 1 as a portable- and/or a travel chamber pot.

* * * * *